US005527117A

United States Patent [19]

Roy

[11] Patent Number: 5,527,117

[45] Date of Patent: Jun. 18, 1996

[54] BRAILLE PRINTING SOLENOID HOUSING

[75] Inventor: Kenneth L. Roy, Centerville, Ohio

[73] Assignee: Impact Devices, Inc., West Carrollton, Ohio

[21] Appl. No.: 343,919

[22] Filed: Nov. 17, 1994

Related U.S. Application Data

[63] Continuation-in-part of Ser. No. 197,178, Feb. 16, 1994, abandoned.

[51] Int. Cl.[6] ..... B41J 3/32; B41J 2/285

[52] U.S. Cl. ..... 400/109.1; 400/124.17; 335/255; 335/260

[58] Field of Search ..... 400/124.17, 124.21, 400/124.22, 124.23, 157.2, 109.1; 335/255, 260; 101/93.04, 93.05

[56] References Cited

U.S. PATENT DOCUMENTS

| | | | |
|---|---|---|---|
| 4,016,965 | 4/1977 | Wirth et al. | 400/124.17 |
| 4,166,991 | 9/1979 | Haner | 335/255 |
| 4,176,975 | 12/1979 | DeBoskey et al. | 400/124.32 |
| 4,200,401 | 4/1980 | Roy et al. | 400/124.17 |
| 4,272,748 | 6/1981 | Fugate et al. | 400/124.17 |
| 4,468,647 | 8/1984 | Gibas | 335/262 |
| 4,478,528 | 10/1984 | Hebert | 400/124.23 |
| 4,749,976 | 6/1988 | Pilcher | 400/157.2 |

FOREIGN PATENT DOCUMENTS

| | | | |
|---|---|---|---|
| 56-011260 | 2/1981 | Japan | 400/157.2 |
| 57-038149 | 3/1982 | Japan | 400/157.2 |

OTHER PUBLICATIONS

Assembly Drawing from serial No. 08/197,178.

*Primary Examiner*—David A. Wiecking
*Attorney, Agent, or Firm*—Nixon & Vanderhye

[57] ABSTRACT

Disclosed is a printing solenoid specifically adapted and improved for the printing of Braille dots and in particular interpoint Braille. A plunger and printing shaft are fixably mounted together and the combination mounted for slidable movement in a rear end cap and in a molded insert bearing between energized and deenergized positions. The plunger/printing shaft combination are located within a bobbin having an electric coil wound thereon. A tubular case encloses the coil and mounts a front bushing which in turn mounts the molded insert bearing. A rear flux washer is held in place between the bobbin by the rear end cap which is retained within the rear portion of the tubular case. During energization, the plunger and printing shaft combination move such that the shaft strikes a piece of paper to be imprinted with a Braille dot. Depending upon whether the dot is to extend away from the solenoid or towards the solenoid, an embossing ball or an embossing recess is used on the end of the printing shaft. An internal return spring moves the plunger/printing shaft combination back to its deenergized position. A high degree of printing accuracy is achieved by slidably mounting the plunger/printing shaft combination in bearings which are separate from the bobbin coil assembly. The end cap is responsive to a torque applying device, and through the rear flux washer and the bobbin, torque can be applied to the bushing to aid in inserting or removing the solenoid from a dense solenoid array.

16 Claims, 2 Drawing Sheets

BRAILLE PRINTING SOLENOID HOUSING

The present invention is a continuation-in-part of now-abandoned U.S. patent application Ser. No. 08/197,178 filed on Feb. 16, 1994 of the same title.

BACKGROUND OF THE INVENTION

1. Field of the Invention

This invention relates to the field of precision axial solenoids and particularly to narrow width, high energy solenoids utilized in printing Braille characters on paper.

2. Discussion of Prior Art

Tubular solenoids are well known for various printing and actuation functions. A specific application of such solenoids is for the imprinting of dots on paper forming the well known Braille pattern in order to provide reading material for the visually handicapped. In such applications, a plurality of solenoids are arranged on a movable carriage where the carriage is capable of movement in both the x and y direction over a shoot of paper. During energization, the tip of the solenoid having a rounded surface thereon will impact the paper to be printed. The rounded tip deforms the paper which backed up by a platen either of hard rubber or a matching depression. The impact of the solenoid plunger on the paper crushes a dimple in the paper which can later be felt by a visually handicapped individual. However, as can be imagined, the time necessary to scan a sheet of paper in both the x and y direction and controllably print the desired. Braille characters thereon is extensive resulting in a relatively high cost for Braille printing materials.

An improvement in the Braille printing process is known as "interpoint" Braille in which two types of solenoids and two types of corresponding platens are utilized. One group solenoids, as noted above, has a rounded end which sandwiches the paper between the solenoid's rounded end and a depression in a corresponding platen. However the other group of solenoids have a hemispherical recess in the end of the solenoid which compresses the paper between the recess and a corresponding projection on the platen. Accordingly, depending upon which solenoid and platen combination is used, a bump can be made in the paper to extend towards the front of the paper or the back of the paper. Consequently, during a single pass over the paper, it can be printed in Braille on both sides thus resulting in a substantial decrease in the cost of printing such materials.

As can be appreciated, it would be desirable to dispense with both carriage systems so less time is spent scanning over the page. A system which utilizes 168 separate solenoids and has no moving carriage is currently being developed to print Braille on both sides of a sheet of paper from a single array of solenoids as the paper makes a single pass. An obvious requirement of such a device is a high energy solenoid capable of reliably deforming various weights of paper and, due to the number of solenoids, must be relatively narrow in diameter.

The spacing between dots on one side of the paper is on the order of 2.5 mm or 0.098". The dots have a width of about 1.25 mm or 0.047". Since a dot on one side of the paper cannot be co-located with a dot on the other side of the paper (in which a deformed dot at best would be provided), the location of the dots on one side of the paper is offset in the x and y directions by approximately 1.25 mm or 0.047" so that the dots on the front of the sheet of paper are "interpointed" with respect to the dots on the back of the sheet of paper. In view of the critical spacing and the need for the end of the solenoid to interact with its corresponding platen recess or projection, it is extremely important that the solenoid be highly accurate in its impact so that the position of the dot does not interfere with adjacent tints.

Conventional tubular solenoids utilize an electric coil wound around a plastic (generally nylon) bobbin. The central aperture in this bobbin is the area through which the plunger moves and is guided between its energized and deenergized state. In practice, the winding tension of coil wire on the bobbin varies between coil winding machines resulting in variations in the actual internal diameter of the plunger passageway. Moreover, as a solenoid is used, especially in the printing field, the coil generates heat which serves to expand the bobbin material which in turn narrows the plunger passageway.

Because of the winding tension variations and the possibility of bobbin expansion resulting in a narrowing of a passageway, the design clearance between the bobbin and the plunger must be maintained relatively high so as to insure that under the worst conditions mere is no binding of the plunger during operation. As a result of design for this worst case situation, conventional tubular solenoids have relatively poor guiding action and are not sufficiently accurate for the printing of Braille characters in particular interpoint Braille.

Furthermore, the close spacing of solenoids used in the printing of Braille characters, and particularly with interpoint Braille, creates difficulties in inserting and removing an individual solenoid from an array of solenoids without disassembling the entire array.

SUMMARY OF THE INVENTION

Therefore, in view of the above, it is an object of the present invention to provide an narrow diameter, high energy printing solenoid with extremely high reliability.

It is a still further object of the present invention to improve the accuracy of high energy narrow diameter solenoids.

It is a still further object of the present invention to provide internal return spring for a high energy narrow diameter solenoid.

It is an additional object of the present invention to provide a method and apparatus to facilitate the removal and/or replacement of an individual solenoid from an array of solenoids without the necessity of disassembling the array.

The above and other objects are achieved by slidably mounting the plunger in a bearing material at each end such that the plunger does not contact the coil or the bobbin upon which the coil may be wound. In a preferred embodiment, the energizing coil is surrounded by a flux carrying case which is closed at the front end by a flux carrying bushing having an insert molded bearing therein. A plunger includes a shaft which extends through the molded bearing and accomplishes the required priming. The rear of the plunger is slidably received into a molded end cap which closes the rear of the solenoid case. To provide reduced reluctance, a flux washer is applied at the rear of the coil. A return spring Is also included to the rear of the coil and within the case of the solenoid.

BRIEF DESCRIPTION OF THE DRAWINGS

The present invention may be more readily understood by reference to the following drawings, wherein.

DETAILED DESCRIPTION OF PREFERRED EMBODIMENTS

Figure 1:
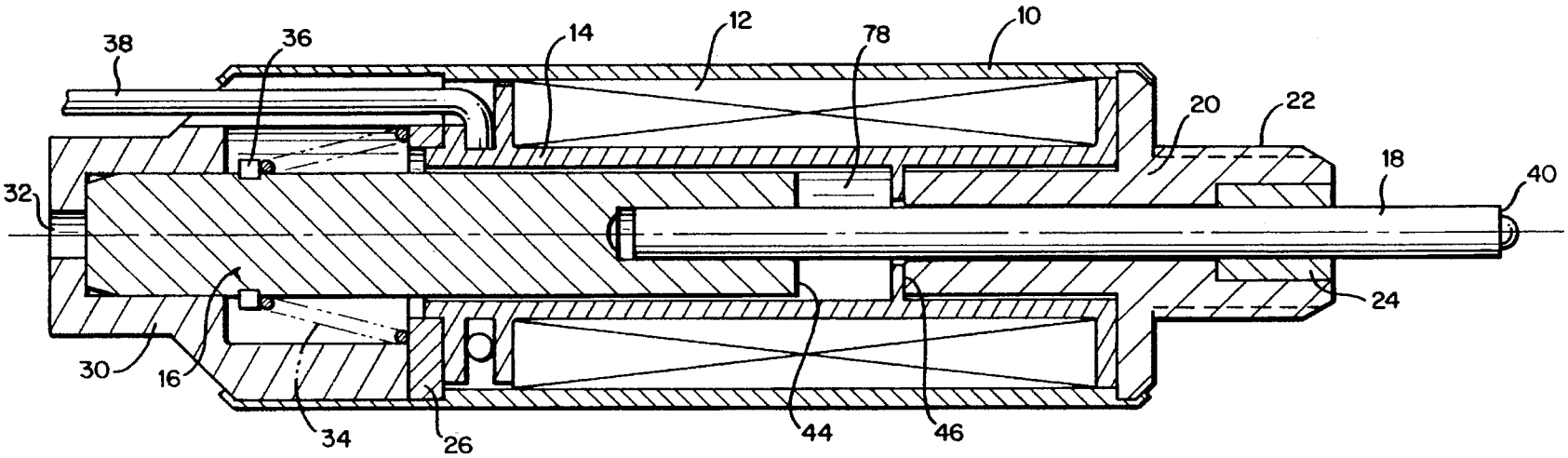
FIG. 1 is a cross sectional side view of a preferred embodiment of the present invention.

A preferred embodiment of the improved Braille printing solenoid is illustrated in FIG. 1 and similar reference numerals will be used among the several views to designate similar parts.

In FIG. 1, there is shown a tubular case 10 surrounding the cylindrically wound coil 12. The coil is actually wound on bobbin 14 which can be made of any generally nonmagnetic material (in a preferred embodiment nylon). The operable portion of the solenoid is a plunger means for impacting a sheet of paper when the solenoid is energized. In one preferred embodiment, the plunger means is comprised of two elements, plunger 16 and a printing shaft 18. During assembly, it is important that the printing shaft be permanently fixed to the plunger since the separation of these two elements would not only disable the solenoid from operation, but if the printing shaft were to escape from the confines of the solenoid, it could disable any mechanism in which the solenoid is mounted. Accordingly, the print shaft is first adhesively bonded to the plunger by the use of a conventional epoxy adhesive along the shaft. Then the shaft is mechanically bonded by "staking" the plunger around the point at which the shaft is received into the plunger. The combination of both s adhesively bonding and mechanically joining the two results in a bond which has extremely high reliability over multiple millions of cycles printing.

It can be seen from FIG. 1 that there is a clearance between the internal passage through the bobbin and plunger 16 and that the bobbin serves no function with respect to guiding movement of plunger 16. The front portion of the shaft is supported by a mounting bushing 20 which serves to close the front of the tubular case. The mounting bushing can have threads 22 located thereon to facilitate mounting in an appropriate printing assembly. In a preferred embodiment, the mounting bushing includes a molded insert bearing 24 through which shaft 18 extends. The shaft is slidably received in this bearing and is supported and guided thereby.

The plunger is shown in its deenergized position and it is understood that upon application of a suitable voltage to coil 12 (in a preferred embodiment 24 volts) a toroidal electromagnetic field will be generated in the coil. This field is carried around the outer portion of the coil by the electromagnetic flux carrying case 10. Flux generated by coil 12, depending upon the polarity of voltage applied to the coil, will travel from the coil into the mounting bushing 20, radially inward towards the printing shaft 18 and then travel rearward along the remainder of the mounting bushing until air gap 28 is encountered. At the rear of the coil is a flux carrying washer 26 which also serves to position and retain the bobbin carrying the coil in position in the case 10.

The flux travels across the high reluctance air gap until reaching plunger 16, rearwardly through the plunger until reaching flux carrying washer 26 and outwardly back into the case. Obviously, if the polarity of voltage applied is reversed, the flux path through the solenoid induced by the coil is also reversed. The importance of having the flux carrying washer, the flux carrying mounting bushing and the flux carrying case is to maintain a flux flow path with the least reluctance possible (reluctance is the resistance to flux flow) so as to generate the highest possible flux density in the air gap 28 (which is responsible for the attraction of the plunger towards the mounting bushing). This flux density in combination with the air gap serves to urge the plunger from the deenergized position (as shown in FIG. 1) to the right to an energized position. This energized position could result in the plunger actually coming to rest against the internal extending portion of the bobbin although preferably the printing shaft will have already come into contact with the printing paper before contact between the plunger and internal extension of the bobbin is obtained.

A rear end cap 30 is also provided which closes the rear portion of the solenoid case. However, and more importantly, a rear portion of the plunger 16 is also slidably received in the rear end cap. Accordingly the molded insert bearing and the rear end cap serve to mount the plunger means for extremely accurate slidable movement. An aperture 32 in the rear end cap permits airflow into and out of the rear end cap as the plunger is energized and deenergized so as to avoid adversely affecting movement of the plunger.

In a preferred embodiment, both the rear end cap 30 and the molded insert bearing 24 are made of nylon and, in particular, a carbon fiber reinforced nylon identified as LNP #4536 available from Delta Polymers in Sterling, Mich. This material is not only lightweight and strong, but has good lubricity and a relatively long operational life (one hundred million plus cycles).

After energization, it is desirable to return the plunger and the print shaft to the deenergized position so as to be ready for the next print command. In a preferred embodiment, a conical coil spring 34 is disposed within the rear end cap and with the front end abutting the flux carrying washer 26. The rear end of spring 34 abuts a retaining ring 36 which is inset into a groove machined in the plunger 16. As can be seen, when the coil has ben energized and the plunger moves to the right towards the energized position, conical coiled spring 34 will be compressed with the result that it will bias the plunger into movement towards the deenergized position as soon as the coil is deenergized. Electricity is supplied to the coil 12 by means of external wire 38.

In FIG. 1, it is noted that the end of printing shaft 18 comprises an embossing ball 40 which during operation would cooperate with a hard rubber platen or a corresponding dimple in a metal platen to emboss the printed paper with a suitable Braille dot. As discussed above, a number of solenoids would be so equipped. However, the remaining solenoids would be equipped with the printing shaft 18 shown in FIG. 2 which includes embossing dimple 42 which, in cooperation with either the hard rubber platen or a corresponding ball in a metal platen, would emboss a Braille dot on the other side of the paper. As can be seen, the embossing ball shown in FIG. 1 would provide a Braille dot which can be felt on the side of a printed paper away from the printing solenoid whereas embossing the dimple 42 shown in FIG. 2 will imprint a Braille dot which can be felt on the solenoid side of the printed paper. The above preferred embodiment is capable of embossing various paper thicknesses from paper known as "fish paper" to a relatively heavy bond paper stock.

In a preferred embodiment of the present invention, the end 44 of plunger 16 is perpendicular W its direction of motion and is parallel to the rear face 46 of mounting bushing 20. This orientation generates the greatest attractive force between the plunger and the mounting bushing and thus maximizes the impact energy at the tip of the printing shaft, although other configurations could be possible.

In view of the above, it will be understood by one of ordinary skill in the art that many variations of this arrangement could be utilized. Depending upon the force/stroke requirements, different combinations of materials and coil sizes could provide different amounts of energy. Different types of rear end cap and molded insert bearing materials could also be used. However, it is important that the plunger/printing shaft assembly be slidingly received through bearing material although it is not critical that such bearing be at the s actual rear end of the plunger and at an intermediate portion of printing shaft 18. It is this bearing support for the plunger/printing shaft combination which provides the exceptional accuracy of applicant's tubular solenoid.

In practice, the outer diameter of the tubular case 10 is approximately 0.500 inches and the air gap is approximately 0.135 inches. The plunger is mild steel which in a preferred embodiment is A.I.S.I. 12 L14 or 12 15 or SAE 1010 or 1008 with The printing shaft in either the FIG. 1 or FIG. 2 embodiment being 303 nonmagnetic stainless steel. The tubular case can be made of seamless steel tubing with a nominal wall thickness of 0.025 inches (which in a preferred embodiment is the same material as the plunger). The mounting bushing and flux ring can be of the same material as the plunger, The return spring, in a preferred embodiment, would comprise a 0.015 diameter stainless steel wire having a variable spring diameter with an outside dimension of 0.29 inches at the large end to an outside diameter of 0.215 inches at the small end. In a preferred embodiment, the spring has a free length of 0.26 inches and h slightly compressed with the plunger in the deenergized position. The spring must be capable of compression to 0.075 inches and preferably has a force of 0.148 pounds when so compressed. A preferred embodiment of the spring utilizes a total of 7 coils and has a life in excess of one hundred million cycles.

Figure 5:
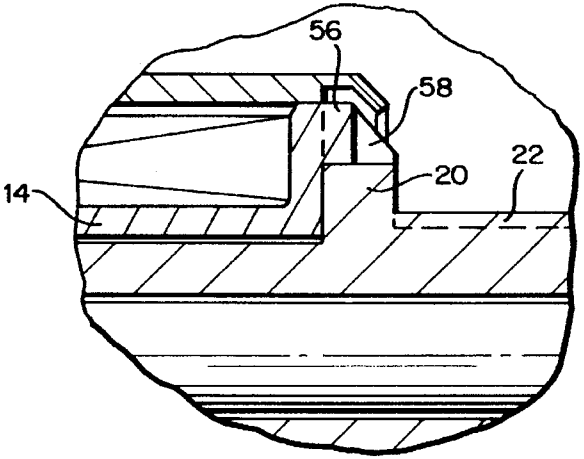
FIG. 5 is an expanded partial cross sectional view of the junction between the bobbin and the mounting bushing of the further improved solenoid.
Figure 4:
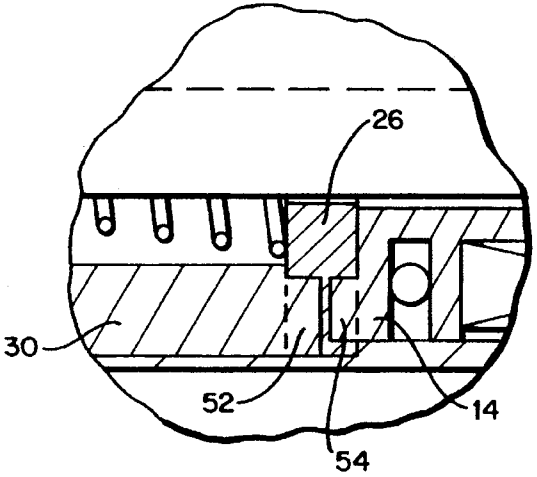
FIG. 4 is an expanded partial cross sectional view of the junction between the end cap, the flux washer and the bobbin of the further improved solenoid.
Figure 3:
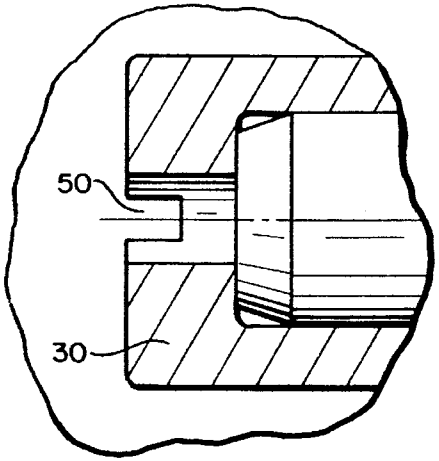
FIG. 3 is an expanded partial cross sectional view of the end cap of the further improved solenoid.

A further improved solenoid, which includes the changes shown in FIGS. 3–5, permits the closely spaced solenoids to easily be replaced without disassembling the entire array of solenoids. The solenoid, which in one embodiment, is mounted by means of threads 22 on the mounting bushing 20, can be mounted by rotation of the entire solenoid around its longitudinal axis with the aid of a driver means such as a screwdriver, nut driver, allen wrench or the like. A rotational mounting means on the mounting bushing is used to fix the solenoid to a mounting plate. In one embodiment, the rotational mounting means is comprised of a threaded or other configuration which is inserted into a similarly configured aperture and rotated to secure the solenoid to the mounting plate. Alternatively, the rotational mounting means could be a nut or other fastener to secure the solenoid to the plate, where the bushing extends through a non-threaded aperture and has a nut or other fastener tightened from the other end while the solenoid is rotationally held in position by the driver means.

In the first embodiment the driver means is used to rotate the solenoid to tighten the threads into the mounting plate where, in the second embodiment, the driver means is used to prevent the solenoid from rotating while the nut or other fastener is applied to the bushing to secure its position. In either embodiment, the driver means is applied to a means for applying torque to the end cap which in a preferred embodiment is slot 50 at the rear of the end cap 30 as shown in FIG. 3.

The solenoid construction is modified to include a means for transmitting torque from the slot 50 to the threaded portion of the mounting bushing 20 and the details of this transmitting means is shown in FIGS. 3–5. In one embodiment shown in FIG. 4, torque is transmitted through the end cap 30 to a projection 52 which extends at least partially into a slot in the flux carrying washer 26. Although, in the embodiment shown, there is a second slot on the other side of the washer 26 with projection 54 from the bobbin is extending into the slot, it is understood that a single slot accommodating both projections 52 and 54 could also be used. The projection 52 serves to transmit torque from the end cap 30 to the flux carrying washer 26. The torque is then transmitted from the washer 26 to projection 54 and the remainder of the bobbin 14. Just as in the previous non-torque transmitting embodiment, the crimping of the case 10 over the rear end cap 30 and the mounting bushing 20 serves to maintain the parts of the solenoid (including the projections and dots) in a fixed alignment.

Torque from the bobbin 14 is applied to the threaded mounting bushing 20 by projection 56 which extends into slot 58 in bushing 20 as shown in FIG. 5. Accordingly, torque applied to the screwdriver slot 50 is carried through the solenoid structure to the mounting bushing 20 allowing the individual solenoid to be easily installed or removed from a threaded mounting hole regardless of the spacing between adjacent solenoids without disassembly of the remaining solenoids.

Figure 2:
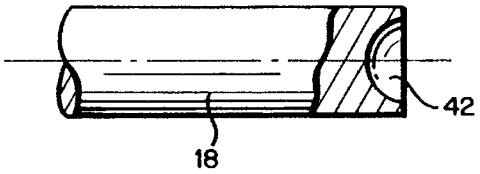
FIG. 2 is a side view partially end section of an alternative embodiment of a print shaft end.

Therefore, and in view of the above, many variations upon the embodiments shown in FIGS. 1 and 2 will be clearly obvious to those of ordinary skill in the art. Accordingly, applicant's invention is limited only by the claims hereinafter recited.

What is claimed is:

1. A printing solenoid, said solenoid comprising:

a plunger means, movable between an energized position and a deenergized position, for impacting a sheet of paler when said plunger is in said energized position;

a coil at least partially surrounding a portion of said plunger means wherein energization of said coil moves said plunger means from said deenergized position to said energized position, said coil generating an electromagnetic flux field during coil energization;

a case at least partially surrounding said coil;

a mounting bushing closing a front portion of said case, said bushing having an aperture through which said plunger means at least partially extends and is slidably mounted, said bushing including means for rotationally mounting said bushing:

a rear end cap for closing a rear portion of said case, said end cap including a means for slidably receiving a rear end of said plunger means for movement between said energized and deenergized positions, said rear end cap including a means, responsive to a driver means, for imparting torque to said rear end cap;

a means for transmitting torque from said means for imparting torque to said means for rotationally mounting said mounting bushing;

a plunger return means for returning said plunger means to said deenergized position; and said bushing and said rear end cap comprising the sole means for mounting said plunger means for slidable movement between said energized and deenergized positions.

2. An improved Braille printing solenoid, said solenoid comprising:

a plunger, movable between an energized position and a deenergized position;

a printing shaft means, mounted to and along a longitudinal axis of said plunger for impacting a sheet upon which Braille is to be printed when said plunger, is in said energized position;

a coil at least partially surrounding a portion of said plunger wherein energization of said coil moves said plunger from said deenergized position to said energized position, said coil generating a flux field during coil energization;

an electromagnetic flux carrying case at least partially surrounding said coil;

an electromagnetic flux carrying mounting bushing closing a front portion of said case, said bushing having an aperture through which said shaft means at least partially extends, said bushing including means for rotationally mounting said bushing;

an electromagnetic flux carrying washer disposed adjacent said coil and within a rear portion of said case;

a rear end cap for closing a rear portion of said case, said end cap including a longitudinal aperture for slidably receiving a rear end of said plunger for movement between said energized and deenergized positions, said rear end cap including means, responsive to a driver means, for imparting torque to said rear end cap;

a means for transmitting torque from said means for imparting torque to said means for rotationally mounting said mounting bushing;

a plunger return spring disposed between said washer and a rear portion of said plunger, said spring compressed at least during movement of said plunger towards said energized position; and a front bearing disposed in said bushing aperture, said bearing including an aperture through which a portion of said shaft is slidingly received for movement between said energized and deenergized positions, said front bearing and said rear end cap comprising the sole means for mounting said plunger and said shaft means for slidable movement between said energized and deenergized positions.

3. An improved Braille printing solenoid in accordance with claim 2, wherein said driver means is a screwdriver and said means for imparting torque comprises at least one slot, compatible with said screwdriver, in the rear end cap.

4. An improved Braille printing solenoid in accordance with claim 2, wherein said means for rotationally mounting said bushing comprises threads formed on said bushing.

5. An improved Braille printing solenoid in accordance with claim 2, wherein said means for transmitting torque comprises:

means defining at least one slot extending at least partially through said electromagnetic flux carrying washer;

said rear end cap including at least one projection extending at least partially into engagement with said at least one slot in said washer;

said bushing further including at least one slot; and said coil including a bobbin upon which wire in said coil is wound, said bobbin including at least one rearward projection extending at least partially into engagement with said at least one slot in said washer and at least one forward projection extending into at least partial engagement with said at least one slot in said bushing, said rear end cap, said washer, said bobbin and said bushing together comprising a torque path from said rear end cap to said bushing.

6. An improved Braille printing solenoid in accordance with claim 2, wherein said coil comprises a coil of wire wound on a bobbin and at least a portion of said plunger passes through a central passageway in said bobbin.

7. An improved Braille printing solenoid in accordance with claim 2, wherein said plunger is mounted for movement without contacting said bobbin.

8. An improved Braille printing solenoid in accordance with claim 2, wherein each of said bearing and rear end cap is at least partially comprised of nylon.

9. An improved Braille printing solenoid in accordance with claim 8, wherein said nylon is comprised of carbon fiber reinforced nylon.

10. An improved Braille printing solenoid in accordance with claim 2, wherein said plunger return spring comprises a coil spring.

11. An improved Braille printing solenoid in accordance with claim 2, wherein said plunger return spring is a conical coiled spring.

12. An improved Braille printing solenoid in accordance with claim 2, wherein said printing shaft means includes an end having an at least partially spherical extending shape.

13. An improved Braille printing solenoid in accordance with claim 2, wherein said printing shaft means includes an end having an at least partially hemispherical recessed shape.

14. An improved Braille printing solenoid in accordance with claim 2, wherein said printing shaft means is fixed in said plunger with an epoxy adhesive.

15. An improved Braille printing solenoid in accordance with claim 2, wherein said printing shaft means is fixed in said plunger by staking of said plunger around said printing shaft means.

16. An improved Braille printing solenoid in accordance with claim 2, wherein said printing shaft means is fixed in said plunger by fixing said shaft means in said plunger with an epoxy adhesive and by staking of said plunger around said printing shaft means.

* * * * *